US007044027B2

(12) United States Patent
Richter

(10) Patent No.: US 7,044,027 B2
(45) Date of Patent: May 16, 2006

(54) WRENCH FOR USE IN LIMITED ACCESS AREAS

(76) Inventor: Milton Richter, 34 Bennet St., Monticello, NY (US) 12701

( * ) Notice: Subject to any disclaimer, the term of this patent is extended or adjusted under 35 U.S.C. 154(b) by 63 days.

(21) Appl. No.: 10/870,452

(22) Filed: Jun. 16, 2004

(65) Prior Publication Data

US 2005/0279192 A1 Dec. 22, 2005

(51) Int. Cl.
*B25B 13/00* (2006.01)

(52) U.S. Cl. ..... 81/58.3; 81/121.1

(58) Field of Classification Search ..... 81/58.3, 81/121.1, 176.2

See application file for complete search history.

(56) References Cited

U.S. PATENT DOCUMENTS

| | | | | |
|---|---|---|---|---|
| 1,355,455 | A | 10/1920 | Doughty | |
| 1,434,635 | A | 11/1922 | Summers | |
| 1,504,035 | A | 8/1924 | Faw | |
| 2,601,800 | A | 7/1952 | Curtis | 81/121 |
| 3,482,481 | A | 12/1969 | Newell et al. | 85/45 |

FOREIGN PATENT DOCUMENTS

| | | | |
|---|---|---|---|
| DE | 575904 | | 5/1933 |
| FR | 2605918 | A1 * | 5/1988 |
| FR | 2645063 | A1 * | 10/1990 |
| FR | 2697193 | A1 * | 4/1994 |
| GB | 16793 | | 4/1913 |
| GB | 604812 | | 7/1948 |
| GB | 2275637 | A * | 9/1994 |

* cited by examiner

*Primary Examiner*—David B. Thomas
(74) *Attorney, Agent, or Firm*—Sandra M. Kotin

(57) ABSTRACT

A wrench compatible for use in limited access areas is made up of two components. A socket with fluted interior walls cooperates with a handle assembly consisting of a head with complementary fluting on its exterior surface attached to one end of a shaft. The head is inserted into the top of the socket and the shaft is rotated as far as the available space permits. The handle assembly is then lifted upward until the head is separated from the socket, the shaft is thereafter returned to the starting point, the head returned to the socket and rotated again. These steps are repeated until the nut or bolt is tightened or removed. The interior fluting permits the rotation of the socket by small or large increments. Additional embodiments include a spring loaded pin that connects the head of the handle assembly to the socket while assisting the head to be raised a sufficient distance for the head of the handle assembly to be rotated and reseated in the socket. Additional sockets with lower portions having different interior diameters can be used with the same handle assembly for nuts and bolts of smaller and larger diameters. An auxiliary extender and an alternate handle assembly make tight or narrow areas more accessible.

19 Claims, 6 Drawing Sheets

WRENCH FOR USE IN LIMITED ACCESS AREAS

FIELD OF THE INVENTION

The instant invention relates to a wrench for use in limited access areas and areas requiring a small turning arc.

BACKGROUND OF THE INVENTION

There are a number of wrenches currently available that can be used to tighten or loosen a nut or headed bolt. One type of flat wrench is of a fixed size and shaped to fit a single nut or bolt, while a wrench with adjustable jaws can be used for nuts or bolts of varying sizes. Socket wrenches are also made to fit a specific nut or bolt. All of these wrenches require a turning arc that is determined by the shape of the nut or bolt. When the socket or jaws of the wrench is shaped like the nut or bolt head, a specific turning arc is needed for the wrench to be effective. For example, a square nut or bolt requires a minimum turning arc of 90° while a hexagonal nut or bolt requires a minimum turning arc of 60°. This means that the wrench must be turned at least by the minimum arc before it can be removed from the nut and reseated. In many instances the location of the nut or bolt does not provide enough space to permit the use of such wrenches. Wrenches with ratchet mechanisms are also well known, but are subject to breakage under excessive forces and can usually be rotated in only one direction.

Doughty, in U.S. Pat. No. 1,355,455, teaches a ratcheted socket wrench specifically designed for use in automobiles where there is limited access to certain nuts and bolts. This wrench has two rotatable ratchet wheels, each on an opposite side of a shank. The two wheels are rotatable with the socket member and wrench head. There is a pawl associated with each ratchet wheel and a pawl releasing member for each side. When the wrench is rotated in one direction one wheel is engaged and the pawl on the other side is released. When rotated in the opposite direction the other wheel is engaged and the first pawl is released. This wrench can be use to both tighten and loosen a nut or bolt and uses a small turning arc, but the mechanism can be subject to breakage under pressure. Summers teaches a wrench designed for use on Ford automobiles in areas with very limited access. (U.S. Pat. No. 1,434,635) The bolt engaging part of the wrench is a spring loaded ratchet mechanism controlling the rotation of a socket. The wrench has a handle consisting of a long solid rod with an L-shaped configuration. The end is bent over upon itself to provide a hand grip. Additionally, the wrench head can be rotated 180° and held fast by a set screw. The combination of handle shape and two head positions enables access to tight areas. Another socket wrench designed for use in motor vehicles has a long thin flat handle with an L-shaped end portion for use as a grip and to provide leverage. The long handle provides access to tight areas. This patent teaches the use of a hexagonal socket interior and also suggests the use of a square, octagonal or fluted socket interior. (Curtis, U.S. Pat. No. 2,601,800)

A wrench consisting of two pieces is taught by Faw in U.S. Pat. No. 1,504,035. A simple socket has an elongated barrel with an axial hexagonal passage and a transverse round passage. A straight handlebar of hexagonal cross section fits the axial passage tightly and the transverse passage loosely. To seat the nut the handlebar is placed in the axial passage and is rotated between the palms of the hands until the nut is screwed as tightly as possible. The handlebar is then inserted into the transverse passage providing considerable leverage to complete the tightening of the nut. In the axial position the wrench can be used in a limited space, but when it is necessary to make the nut tight, a much larger turning area is required since the transverse use requires the full area traversed by the handlebar.

A novel bolt or nut head is taught by Newell et al. in U.S. Pat. No. 3,482,481. The head is frustoconical with two sets of grooves. The grooves in each set are parallel and oblique to the generatrix of the cone. One set of grooves slants to the right and the other to the left. The cooperating wrench has two ends, each with a frustoconical socket having one set of ribs, the set at one end corresponding to the right slanting grooves and the set at the other end corresponding to the left slanted grooves. One end of the wrench is used to tighten the bolt and the other to loosen it. The frustoconical shape requires the wrench to be separated only a small distance from the bolt head but the turning arc is determined by the spacing of the ribs. The wrench and bolt head must be used as a combination and neither can accommodate or be accommodated by conventional hardware.

British patent No. 16,793 to Delacroix describes a rod having one end with five surfaces, each with a raised cross. The rod is used with a set of sockets to fit different sized nuts. Each socket has two notches in its upper surface. The notches cooperate with the crosses. Each cross connects the rod to the socket at a different angle which enables access to a different limited space. German patent No. 575,904 to Forst shows a socket wrench consisting of a shank with connecting means at both ends and a socket member with two sockets of different interior diameters set at right angles to each other. Each socket interior cooperates with one end of the shank. The socket not attached to the shank forms the usable part of the wrench. This wrench can only be used with nuts and bolts of sizes corresponding to the socket selected.

Patent 604,812 from Great Britain describes a one piece socket wrench with a fluted socket interior specifically designed for use when the nut is so close to a wall that the socket cannot fit over the nut. A part of the exterior wall of the socket is ground off to form a sloping face. The socket is placed over the nut with the ground face adjacent to the wall or other obstruction. The nut is turned as far as possible and the socket is removed and reseated.

The ratchet wrenches described above are subject to breakage under large forces while many of the other wrenches are made for specific uses and are not practical for general usage. There is a need for a wrench that can be used to tighten or loosen a nut or bolt situated in any hard to reach area and where only a small turning arc is available. There is a need for a wrench that has minimal components and can withstand the large forces often necessary to remove a nut or bolt that has been in place for a long time. There is a need for a wrench that is adaptable for nuts and bolts of different sizes and shapes and one that is inexpensive and simple to manufacture.

BRIEF SUMMARY OF THE INVENTION

The instant invention may provide a socket wrench for use in tight areas where there is limited access or a very small turning arc or both. The wrench may have two basic components and no moving parts. The wrench may not be damaged under the stress of normal use and may be used with nuts and bolts of various shapes. Accommodations may be made for nuts and bolts of different sizes.

It is an object of the instant invention to provide a wrench that can be used where there is limited access to the site of the nut or bolt to be tightened or loosened.

An object of the instant invention is to provide a wrench that can be used where there is only enough space for a small turning arc.

It is another object of the instant invention to provide a wrench that is easy and inexpensive to manufacture.

A further object of the instant invention is to provide a wrench with a socket that can be used with nuts and bolts of different shapes.

A still further object of the instant invention is to have a wrench that can be rotated to the right or to the left as needed without adjustments or alterations.

Another object of the instant invention is to provide a wrench that is strong enough to withstand considerable force without becoming damaged or distorted.

A further object of the instant invention is to provide a wrench that enables resetting the handle with minimal separation of the handle from the socket.

Another object of the instant invention is to provide a wrench that requires no separation of the socket from the nut or bolt while the handle is reset.

A still further object of the instant invention is to have a wrench that can be used by a right-handed or left-handed person with equal ease.

A wrench for use in limited access areas to tighten or remove nuts and bolts comprises a hollow cylindrical socket having vertically fluted interior walls and a handle assembly comprising a horizontal shaft and a cylindrical head fixedly attached to one end of the shaft, the head having a vertically fluted exterior to complement the fluted interior walls of the socket, and the head being insertable into the socket for driving rotation thereof by movement of the shaft through an arc. When the socket is placed over a nut or bolt and the head is inserted into the top of the socket the shaft can be rotated thereby causing the socket and the nut or bolt to be rotated with it and thereafter the head is lifted clear of the socket, returned to the starting position, and reinserted into the socket so the shaft can be rotated again, and these steps are repeated as needed to tighten or remove the nut or bolt.

A wrench for use in limited access areas to tighten or remove nuts and bolts comprises a hollow cylindrical socket having fluted interior walls; a horizontal partition dividing the interior of the socket into an upper chamber and a lower chamber, the walls of the upper chamber and the fluting in the upper chamber converging inwardly toward the partition, and the walls of the lower chamber and the fluting in the lower chamber being vertical; and a handle assembly comprising a horizontal shaft and a frustoconical head fixedly attached to one end of the shaft, the head having a fluted exterior to complement the fluted interior walls of the upper chamber of the socket, and the head being insertable into the socket for driving rotation of the socket by movement of the shaft through an arc. When the socket is placed over a nut or bolt and the head is inserted into the upper chamber of the socket so that the fluted exterior of the head cooperates with the fluted interior of the upper chamber the shaft can be rotated thereby causing the socket and with it the nut or bolt to be rotated, and thereafter the head is lifted upwardly of the socket a distance sufficient only to permit the flutings to separate and the shaft to be returned to the starting position and thereafter the head is reinserted into the socket so the shaft can be rotated again, and these steps repeated as needed to tighten or remove the nut or bolt.

An extension for use with a wrench of a type having a socket with fluted interior walls and a handle assembly having a head complementing the interior of the socket and affixed to one end of a shaft that comprises an upper body member having a circular recess with fluted walls dimensioned to accept the head of the handle assembly, a rod having a first end and a second end and being fixedly attached at its first end to the bottom of the upper body member at the center thereof, a lower body member being cylindrical with a fluted exterior, dimensioned to be matingly accepted within the socket, and affixed to the second end of the rod; and retention means disposed within the lower body member for retaining said lower body member within said socket. When the lower body member is inserted into and retained within the socket and the handle assembly is inserted into the upper body member the wrench can be used in areas with very limited access to tighten and loosen nuts and bolts.

A handle assembly for driving rotation of a socket of a type having fluted interior walls comprises a rod having a first end and a second end and a U-shaped portion substantially near the first end, a hand grip rotatably affixed to the first end of the rod, a head being cylindrical with a fluted exterior and dimensioned to be matingly accepted within the socket affixed to the second end of the rod, and retention means disposed within the head for retaining said head within said socket. When the head is inserted into and retained within the socket and the user holds the hand grip in one had and the vertical part of the U-shaped portion of the rod in the other hand and rotates the rod, the socket is rotated thereby rotating a nut or bolt held within the socket and situated in a limited access area.

A wrench for use in limited access areas to tighten or remove nuts and bolts comprises a hollow cylindrical socket having an upper portion and a lower portion, said upper portion having fluted exterior walls and said lower portion having vertically fluted interior walls and a handle assembly that comprises a horizontal shaft and a cylindrical head fixedly attached to one end of the shaft, the head having a circular recess in the underside, the recess having fluted walls to complement and cooperate with the fluted exterior walls of the upper portion of the socket, and the head being superposable onto the upper portion of the socket for driving rotation thereof by movement of the shaft through an arc. When the socket is placed over a nut or bolt and the head is superposed onto the upper portion of the socket the shaft can be rotated thereby rotating the socket and the nut or bolt and thereafter the head is lifted from the socket, returned to the starting position, and repositioned onto the socket so the shaft can be rotated again, and these steps are repeated as needed to tighten or remove the nut or bolt.

Other features and advantages of the invention will be seen from the following description and drawings.

DETAILED DESCRIPTION OF THE INVENTION

Figure 1:
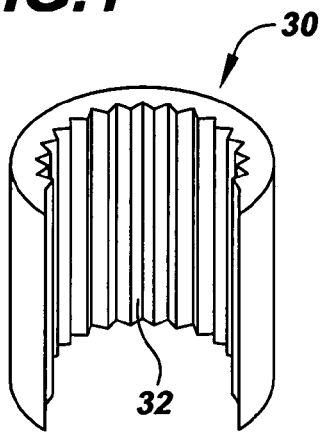
FIG. 1 is a cutaway perspective view of one form of the device of the instant invention.
Figure 2:
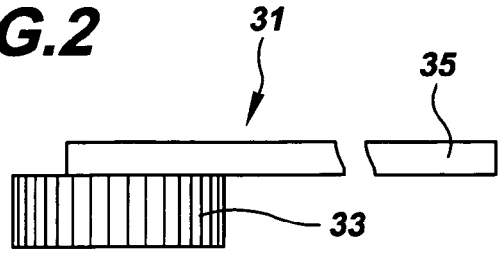
FIG. 2 is a side plan view of the handle assembly.
Figure 3:
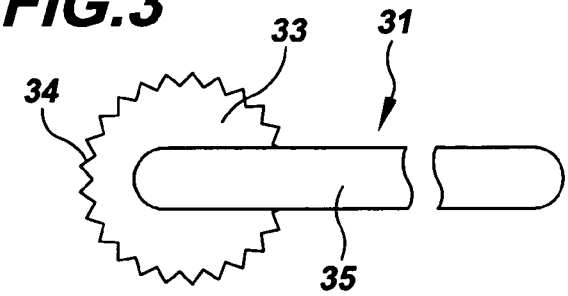
FIG. 3 is a top plan view of the handle assembly.
Figure 4:
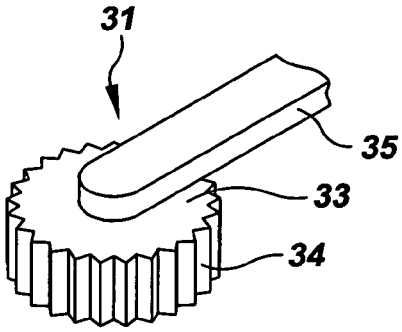
FIG. 4 is a perspective view of a portion of the shaft and the head.
Figure 5:
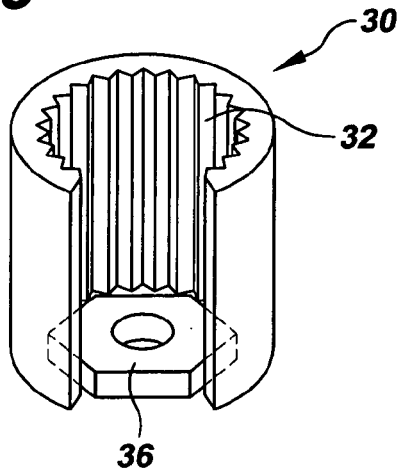
FIG. 5 is a cutaway perspective view of the device of FIG. 1 with a nut.
Figure 6:
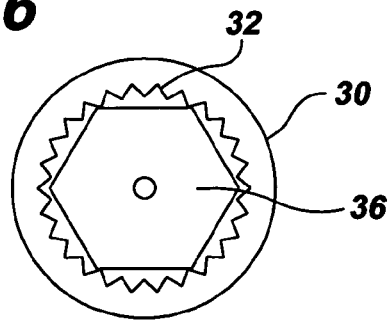
FIG. 6 is a bottom plan view of the device of FIG. 1 with a nut.

A first embodiment of the instant invention may consist of two parts, the socket 30 and the handle assembly 31. The socket 30, seen in FIGS. 1 and 5, may be a hollow cylinder that may have axially fluted interior walls. The fluting 32 may provide a good grip on nuts and bolts having different shapes, i.e., square or hexagonal. An example of a hexagonal nut 36 within the socket 30 may be seen in FIGS. 5 and 6. The handle assembly 31 may have a solid cylindrical head 33 with fluting 34 on its outer surface which may cooperate with and complement the fluting 32 of the interior of the socket 30. The head 33 may be attached to one end of a shaft 35. The shaft 35 may be affixed to the head 33 by welding or other means known in the art. The head 33 and shaft 35 may also be of singular construction. See FIGS. 2, 3 and 4. The head 33 may be inserted into the top of the socket 30 to form a socket wrench.

To use the wrench the socket 30 may be placed over the nut 36 or bolt (not shown) and the head 33 of the handle assembly 31 inserted into the top of the socket 30. The shaft 35 may be rotated in one direction as far as possible, then the head 33 lifted until it may be separated from the socket 30 so the shaft 35 may be rotated to the starting position, reseated in the socket 30 and rotated again. These steps may be repeated until the nut or bolt is tightened sufficiently or removed, as needed. The smaller the available turning arc, the more often these steps must be repeated to complete the task. The fluted interior of the socket and exterior of the head may enable use of this wrench when only a very small turning arc is available.

Figure 7:
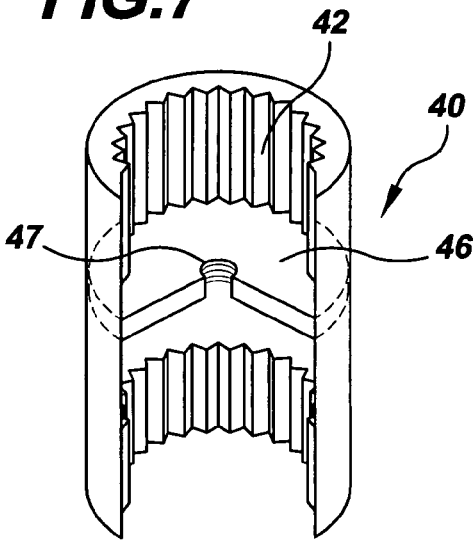
FIG. 7 is a cutaway perspective view of a second embodiment of the device of the instant invention.
Figure 8:
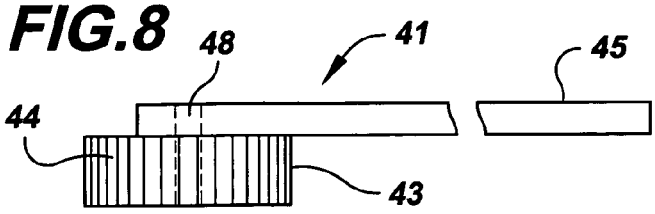
FIG. 8 is a side plan view of a second form of the handle assembly.
Figure 9:
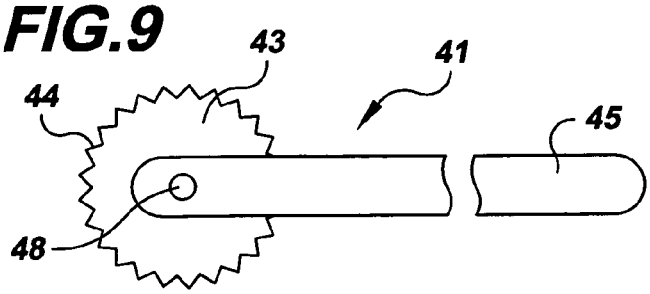
FIG. 9 is a top plan view of the second form of the handle assembly.

A second embodiment of the instant invention may also consist of a hollow cylindrical socket 40 and handle assembly 41. Referring to FIG. 7, the socket 40 may be divided into two interior compartments, an upper compartment and a lower compartment, by means of a transverse partition 46. The interior walls of both compartments may be fluted. The fluting 42 of the upper compartment may have the same tooth size and arrangement as in the lower compartment, or it may be different, according to usage and method of manufacture. There may be a depression or opening 47 with threaded walls centrally located on the upper surface of the partition 46. Alternatively, a threaded nut or small cylinder (not illustrated) may be welded to the center of the partition. The handle assembly 41 may also consist of a solid cylindrical head 43 with a fluted 44 outer surface and a shaft 45. There may be a smooth bore 48 through the end of the shaft 45 and extending through the center of the head 43. FIGS. 8 and 9.

Figure 10:
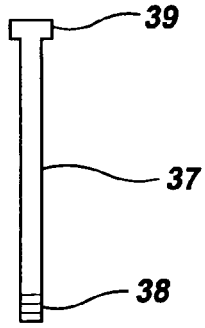
FIG. 10 is a side plan view of the connecting pin.

A pin 37 having one threaded end 38 and one flattened end forming a stop 39 (FIG. 10) may be a part of the wrench. The pin 37 may be inserted downwardly through the bore 48 and fastened into the opening 47 in the partition 46 by mating the threading 38 of the pin 37 with the threaded wall of the opening 47 in the partition 46. The length of the pin 37 may be slightly greater than the sum of the thickness of the shaft 45, the depth of the head 43, and the depth of the upper compartment of the socket 40. The diameter of the pin 37 may be slightly smaller than the diameter of the bore 48 so that the pin 37 may be easily inserted through the bore 48 and so that the head 43 may be smoothly moved upward and downward while the pin 37 remains fixed in the opening 47 in the partition 46. The stop 39 of the pin 37 may be larger than the bore 48 so that the head 43 may not slip off the end of the pin 37. The pin 37 may be used to prevent the head 43 from becoming completely disengaged from the socket 40 and so the head 43 may be quickly and accurately reinserted into the socket 40 for greater efficiency during use.

In operation, the head 43 may be set into the upper compartment of the socket 40 where the fluting 44 of the head 43 and the fluting 42 of the socket 40 may be in intimate cooperation. The pin 37 may be inserted through the bore 48 and held in place by means of the treaded opening 47. The socket 40 may be placed over the nut or bolt to be manipulated and the shaft 45 rotated as far as space may permit. The handle assembly 41 may then be lifted upward until the fluting 44 of the head 43 is no longer in cooperation with the fluting 42 of the socket 40 while the pin 37 may prevent complete separation of two components. The shaft 45 may then be rotated in the reverse direction and the head 43 lowered back into the socket 40. These steps may be repeated as many times as necessary until the nut or bolt is as tight as desired or as loose as desired.

Figure 11:
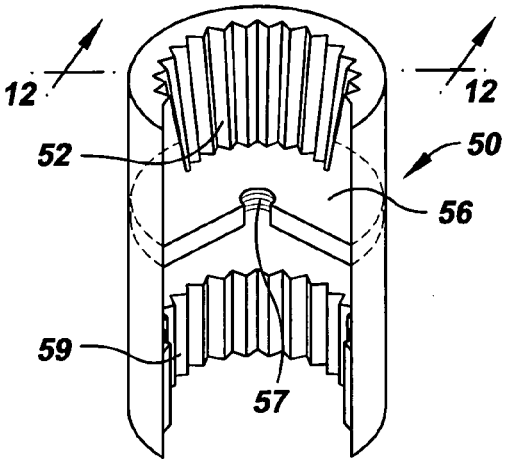
FIG. 11 is a cutaway perspective view of a third embodiment of the device of the instant invention.
Figure 13:
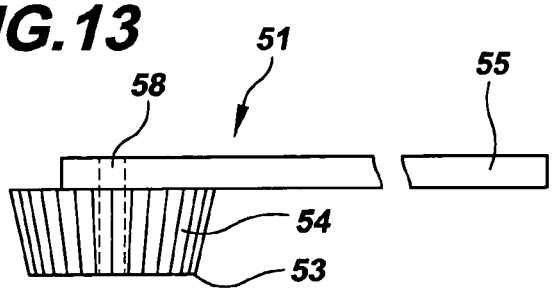
FIG. 13 is a side plan view of a third form of the handle assembly.
Figure 12:
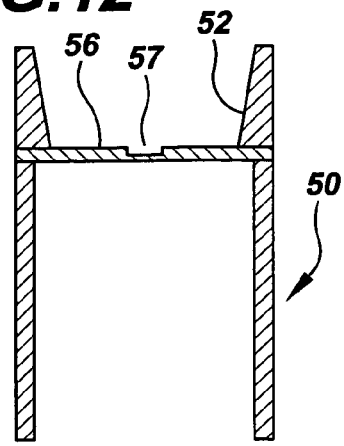
FIG. 12 is section through line 12—12 of FIG. 11.

A third embodiment of the instant invention may be the most efficient when operating in a limited space. A socket 50 may be constructed in a similar manner to socket 40, having a partition 56 separating the interior into two compartments. There may be a threaded depression or opening 57 in the center of the upper surface of the partition 56. The lower compartment may have fluting 59 as previously noted. However, the fluting 52 in the upper compartment may converge inwardly toward the partition 56. See FIGS. 11 and 12. To accommodate the converging fluting 52 in the upper compartment, the handle assembly 51 may be altered accordingly. The head 53 of the handle assembly 51 may be frusto-conical in shape and may have fluting 54 on its exterior surface to cooperate with the converging fluting 52 of the upper compartment of the socket 50. There may be a bore 58 through the end of the shaft 55 of the handle assembly 51 and through the head 53 as seen in FIG. 13. A pin 60 with a threaded end 61 may be disposed within the bore 58 and screwed into the threaded opening 57 in the partition 56 of the socket 50. The socket 50 and handle assembly 51 form a wrench that is operable as described above. However, the inward sloping fluting 52 and frusto-conical head 53, enable the user to reset the wrench by merely lifting the handle assembly 51 a very small distance above the socket 50. This dissociates the two components sufficiently to rotate the handle assembly 51 in either direction and reinsert it into the socket 50. These steps may be repeated as necessary and the turning arc may be as great or as small as the working space permits. The pin 60 of the third embodiment 50 need only be slightly longer than the thickness of the shaft 55 and the depth of the head 53 taken together.

Figure 16:
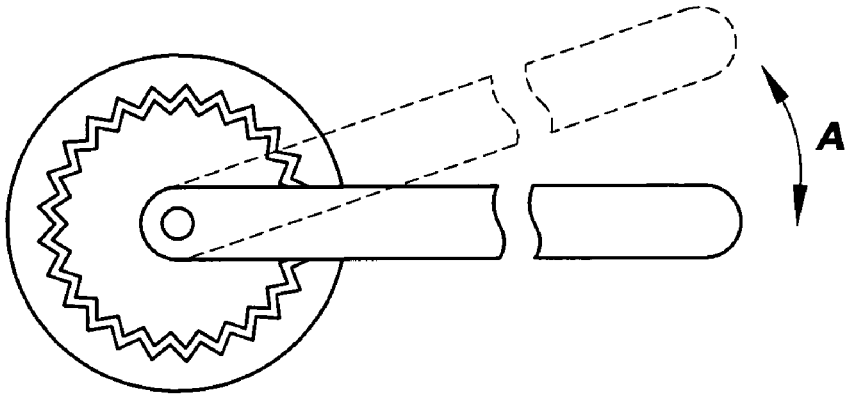
FIG. 16 is a top plan view of a handle assembly showing a small turning angle.
Figure 17:
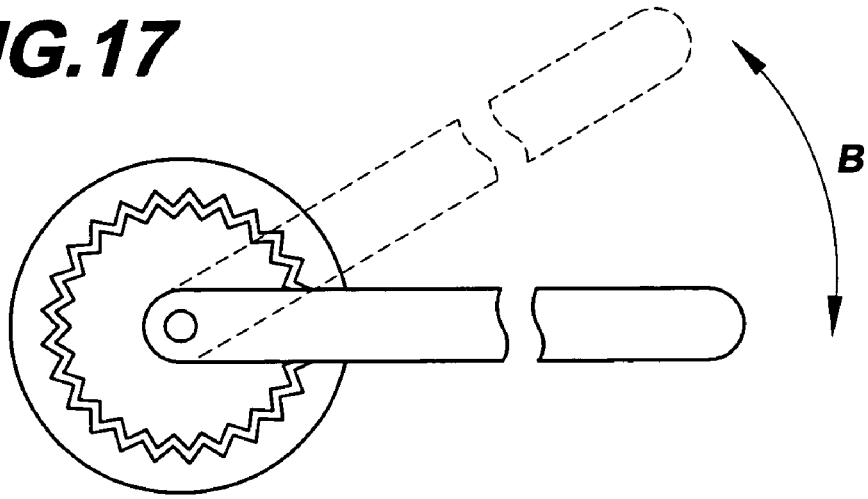
FIG. 17 is a top plan view of a handle assembly showing larger turning angle.
Figure 18:
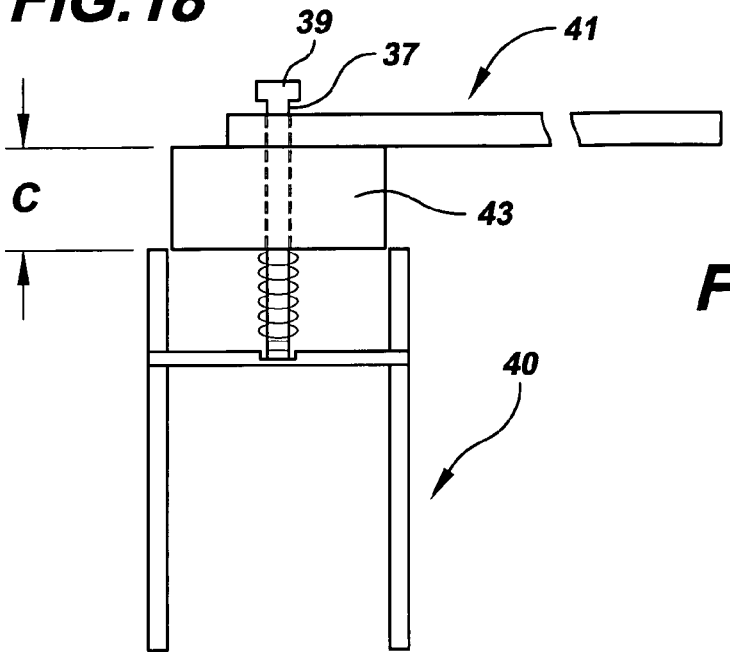
FIG. 18 is a sectional view of the second embodiment of the instant invention showing the clearing distance for the head.
Figure 19:
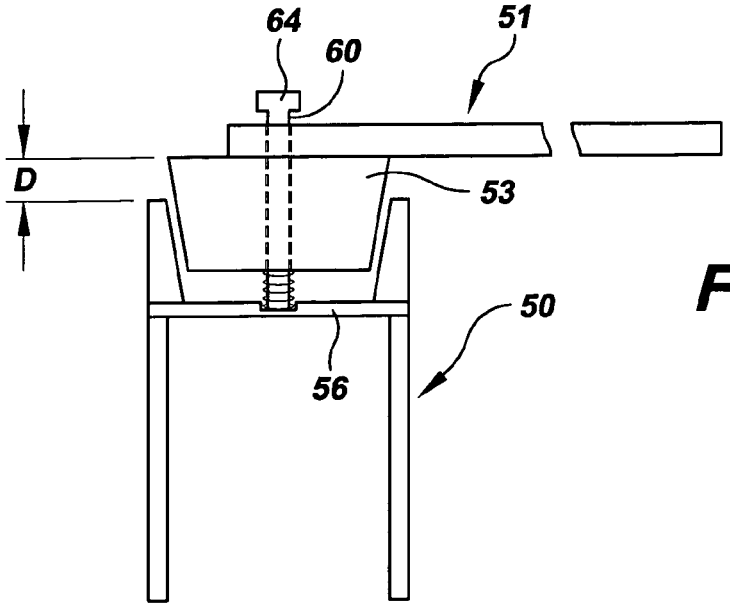
FIG. 19 is a sectional view of the third embodiment of the instant invention showing the clearing distance for the head.

A small turning arc A may be seen in FIG. 16, while a larger turning arc B is illustrated in FIG. 17. When the straight sided socket 40 is used, the head 43 must be lifted upward a distance equal to the full depth of the head 43, the distance C as seen in FIG. 18, before the head 43 may be reinserted. The advantage of the alternately shaped system of the third embodiment may be evident in reviewing FIG. 19 which may illustrate the small distance D the head 53 must be lifted to disengage the two components before rotating and reseating the head 53.

Figure 14:
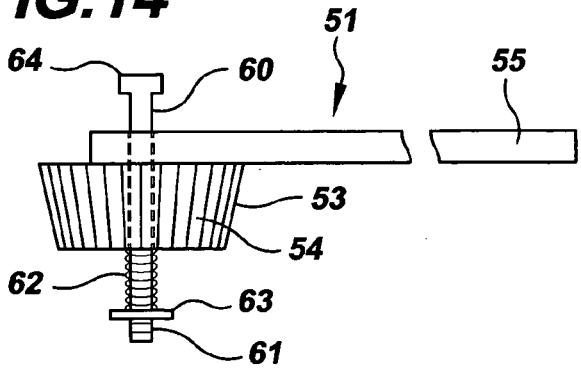
FIG. 14 is a side plan view of the third form of the handle assembly with pivot pin and spring in place.

To further increase the efficiency of the wrench, a compression spring 62 may surround the lower portion of the pin 60 extending beyond the bottom of the head 53. A washer 63 may be placed against the spring 62 before the pin 60 is screwed into the threaded opening 57 in the partition 56 of the socket 50. The pin 60 may have a flattened or enlarged stop 64 at the top so the head 53 may be restrained by the pin 60 from becoming completely separated from the socket 50 even under the tension of the spring 62. See FIGS. 14 and 15.

Figure 15:
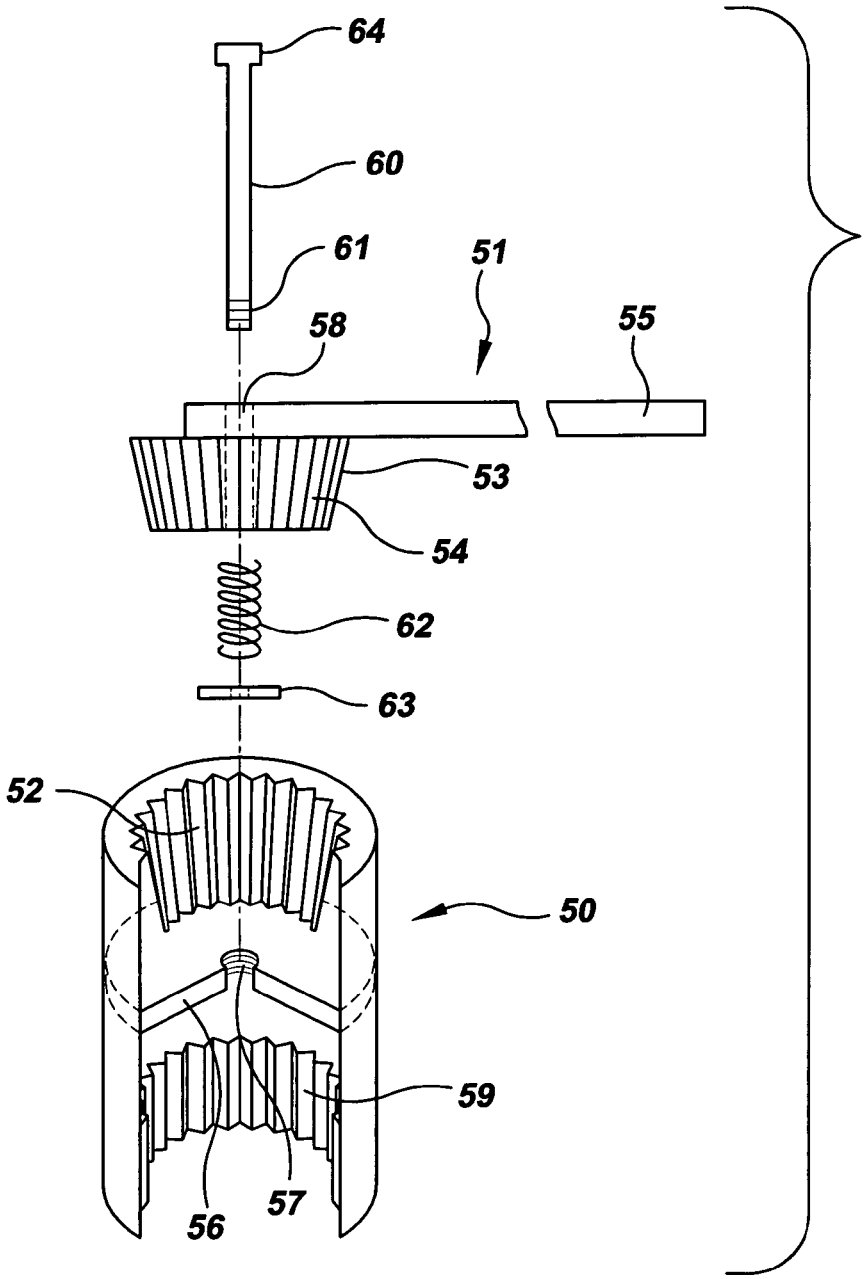
FIG. 15 is an exploded view of the third embodiment of the instant invention.

To operate the wrench composed of socket 50, handle assembly 51, and pin 60 with the spring 62, the components may be put together as illustrated in FIG. 15. The socket 50 may be placed over the nut or bolt to be rotated and the shaft 55 pressed downward to engage the flutings 52 and 54. The shaft 55 may then be rotated to the left or right as needed and through the turning distance or arc as permitted by the accessible space. When rotated as far as possible the pressure on the shaft 55 may be released so that the spring 62 forces the head 53 upward. The length of the pin 60 may be dimensioned to permit the head to be raised just far enough to disengage the fluting 54 of the head 53 from the fluting 52 of the socket 50. The frusto-conical shape of the head 53 and the corresponding shape of the upper compartment of the socket 50 may enable a very short distance D through which the head 53 must be raised to disengage the head 53 from the socket 50. See FIG. 19. Once the flutings are disengaged the user may rotate the shaft in either direction as far as permitted by the available space and thereafter press the shaft 55 downward to re-engage the components. The above described steps may be repeated until the nut or bolt is tightened sufficiently or removed.

It should be noted that if the socket 40 and handle assembly 41 of the second embodiment are used with the pin 37, a spring and washer may be used also. For these components, the pin 37, as noted above must be long enough to raise the head 44 above the socket 40 in order to disengage the flutings, with or without the assist of the spring. See FIG. 18.

Figure 20:
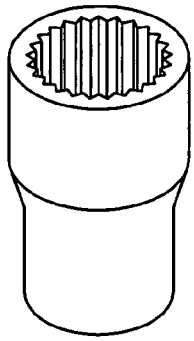
FIG. 20 is a perspective view of one additional socket.
Figure 21:
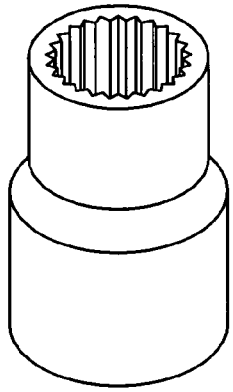
FIG. 21 is a perspective view of a second additional socket.

The fluted socket may enable one socket to accommodate a variety of nuts and bolts of different shapes and, within limitations, different sizes. One single handle assembly may be used with more than one socket as long as the upper compartments of the sockets are of the same dimensions and have the same fluting arrangement to cooperate with the fluting of the head. The socket may then have a lower compartment with a smaller diameter to accommodate smaller nuts and bolts as seen in FIG. 20, or a lower compartment with a larger diameter as seen in FIG. 21 to accommodate larger nuts and bolts. The wrench may be sold in combinations with one handle assembly and several sockets. There may be more than one such wrench combination to accommodate most common nut and bolt sizes.

Figure 22:
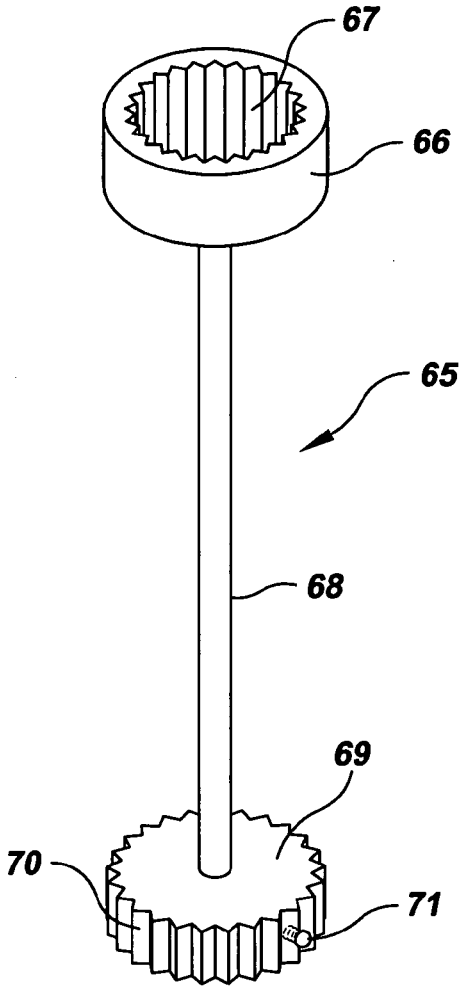
FIG. 22 is perspective view of an extension for the head for hard to reach areas.

At times the nut or bolt to be rotated may be recessed in such a way that the handle assembly cannot reach into the area. An extender 65 may be used with the wrench. A typical extender 65 seen in FIG. 22 may have a female cylindrical upper member 66 of comparable dimensions as the upper compartment of the socket and having the same fluting 67. One end of a rod 68 may be affixed to the underside of the upper member 66 and the other end of the rod 68 may be affixed to a solid cylindrical male member 69. The male member 69 may have fluting 70 about its outer surface to cooperate with the fluting of the upper compartment of the socket. In operation, the male member 69 of the extender 65 may be inserted into the upper compartment of the socket so that the user may extend the socket into the recessed area and place it over the nut or bolt to be rotated. To insure that the socket does not separate from the extender 65 a spring loaded ball 71 or other retention means known in the art may be placed within a recess in the male member 69 to hold it in place within the socket. The handle assemblies 35 and 45 described above may be used with the extender 65 in the described manner. Handle assembly 51 may require the interior fluting of the upper member of the extender to converge downwardly so as to accommodate the head 53, and the male member to be frustoconical in shape.

Figure 23:
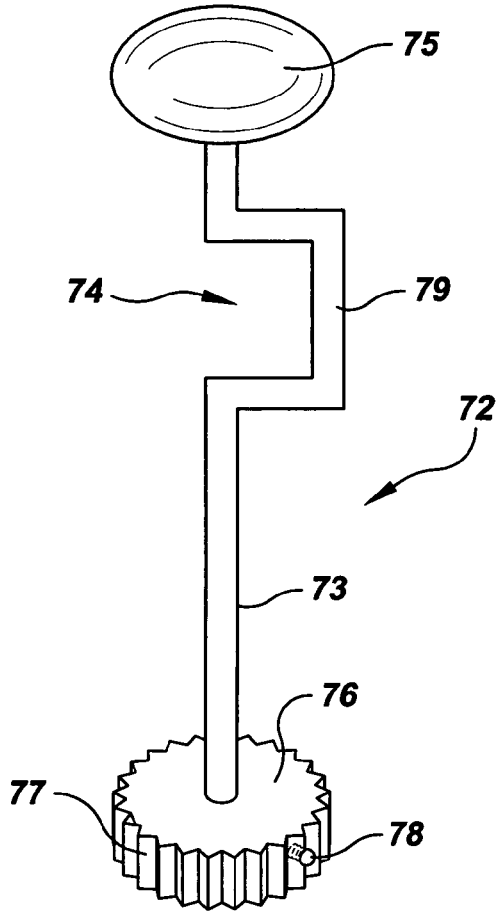
FIG. 23 is a perspective view of an alternate handle assembly for hard to reach areas.
Figure 24:
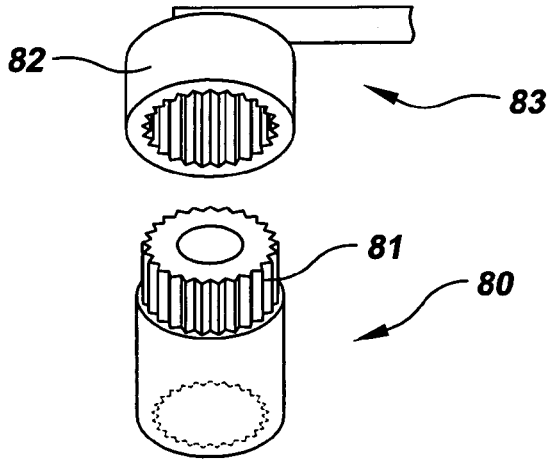
FIG. 24 is a perspective view of an alternate handle assembly head and socket.

When the nut or bolt to be rotated may be situated within a recess with insufficient room to permit any rotation of the handle assembly an alternate handle assembly may be used. One type of alternate handle assembly 72 may be seen in FIG. 23. A configured rod 73 may have a U-shaped section 74 near the top. There may be hand grip 75 rotatably affixed to the top of the rod 73. A solid cylindrical male member 76 with fluting 77 about its outer surface may be affixed to the bottom of the rod 73. In operation, the male member 76 may be inserted into the upper compartment of the socket in the same manner as noted above for the extender 65. To insure that the socket does not separate from the male member 76, a spring loaded ball 78 or other retention means known in the art may be placed within a recess in the male member 76. The combination unit may then be lowered to the site of the nut or bolt to be rotated and placed over the nut or bolt. The hand grip 75 may be held in one hand and the vertical portion 79 of the U-shaped section of the rod 73 may be held in the other hand. The rod 73 may then be rotated using both hands and the nut or bolt may be rotated with it. This alternate handle assembly 72 may also be used when a nut or bolt is resistant to rotation when only a small rotation arc is available, since the added leverage obtained by the use of two hands may provide an advantage. Also, continued rotation may be possible when using the alternate handle 72 since it may not have to be reset after each rotation. A similar alternate handle assembly with a frustoconical male member may be used with the socket 50 of the third embodiment.

The various embodiments of the sockets of the instant invention may be manufactured from one single cylinder, more especially socket 30. The other embodiments, sockets 40 and 50 may be made from one piece or they may be made from two sections welded together with the partition welded between the two sections.

It may also be noted that the wrench may be made with an alternate socket 80 which may have a male member 81 as its upper section and a female member 82 as the head of the handle assembly 83. A set of two or more sockets with different sized lower compartments may be accommodated by the same handle assembly 83.

While several embodiments of the instant invention have been illustrated and described in detail, it is to be understood that this invention is not limited thereto and may be otherwise practiced within the scope of the following claims.

I claim:

1. A wrench for use in limited access areas to tighten or remove nuts and bolts, said wrench comprising:

a hollow cylindrical socket having vertically fluted interior walls; and a handle assembly comprising a horizontal shaft and a cylindrical head fixedly attached to one end of the shaft, said head having a vertically fluted exterior to complement the fluted interior walls of the socket, and the head being insertable into the socket for driving rotation thereof by movement of the shaft through an arc;

whereby when the socket is placed over a nut or bolt and the head is inserted into the top of the socket the shaft can be rotated thereby causing the socket and the nut or bolt to be rotated with it and thereafter the head is lifted clear of the socket, returned to the starting position, and reinserted into the socket so the shaft can be rotated again, and these steps are repeated as needed to tighten or remove the nut or bolt.

2. A wrench as described in claim 1 further comprising a horizontal partition dividing the interior of the socket into an upper chamber and a lower chamber.

3. A wrench as described in claim 2 further comprising a threaded accepting means disposed at the center of said partition for accepting a threaded pin.

4. A wrench as described in claim 3 wherein the handle assembly further comprises a vertical bore through the end portion of the shaft and the center of the head.

5. A wrench as described in claim 4 further comprising a pin substantially longer than the sum of the depth of the head, the thickness of the shaft, and the depth of the upper chamber of the socket, said pin having an upper end and a lower end; stop means at the upper end of the pin; and threading at the lower end of the pin;

whereby when the pin is inserted downwardly through the bore and the threaded lower end matingly inserted into the threaded accepting means in the partition the head can be inserted into the socket for driving rotation thereof and thereafter can be lifted clear of the socket, returned to the starting position, and reinserted into the socket so the shaft can be rotated again, and these steps are repeated as needed to tighten or remove the nut or bolt and the stop means prevents the handle assembly from being completely separated from the socket.

6. A wrench as described in claim 5 further comprising a spring interposed between the lower surface of the head and the upper surface of the partition and surrounding the lower portion of said pin, whereby when pressure is exerted on said shaft the spring is compressed and when pressure is release said spring expands and assists in lifting the head clear of the socket a sufficient distance to permit free rotation of the shaft.

7. A wrench as described in claim 1 further comprising a second hollow cylindrical socket, said second socket having an upper portion and a lower portion, and fluted interior walls, the interior diameter of the upper portion being identical to the interior diameter of the first socket and the interior diameter of the lower portion being larger than the interior diameter of the first socket such that the second socket can be used to tighten and loosen nuts and bolts of similar diameter to the interior diameter of this lower portion and utilizing the handle assembly.

8. A wrench as described in claim 1 further comprising a third hollow cylindrical socket, said third socket having an upper portion and a lower portion, and fluted interior walls, the interior diameter of the upper portion being identical to the interior diameter of the first socket and the interior diameter of the lower portion being smaller than the interior diameter of the first socket such that the third socket can be used to tighten and loosen nuts and bolts of similar diameter to the interior diameter of this lower portion and utilizing the handle assembly.

9. A wrench for use in limited access areas to tighten or remove nuts and bolts, said wrench comprising:

a hollow cylindrical socket having fluted interior walls;

a horizontal partition dividing the interior of the socket into an upper chamber and a lower chamber, the walls of the upper chamber and the fluting in the upper chamber converging inwardly toward the partition, and the walls of the lower chamber and the fluting in the lower chamber being vertical; and a handle assembly comprising a horizontal shaft and a frustoconical head fixedly attached to one end of the shaft, said head having a fluted exterior to complement the fluted interior walls of the upper chamber of the socket, and the head being insertable into the socket for driving rotation of said socket by movement of the shaft through an arc;

whereby when the socket is placed over a nut or bolt and the head is inserted into the upper chamber of the socket so that the fluted exterior of the head cooperates with the fluted interior of the upper chamber the shaft can be rotated thereby causing the socket and with it the nut or bolt to be rotated, and thereafter the head is lifted upwardly of the socket a distance sufficient only to permit the flutings to be separated and the shaft to be returned to the starting position and thereafter the head is reinserted into the socket so the shaft can be rotated again, and these steps repeated as needed to tighten or remove the nut or bolt.

10. A wrench as described in claim 9 further comprising a threaded accepting means disposed at the center of said partition for accepting a threaded pin.

11. A wrench as described in claim 10 wherein the handle assembly further comprises a vertical bore through the end portion of the shaft and the center of the head.

12. A wrench as described in claim 11 further comprising a pin substantially longer than the combined depth of the head and the thickness of the shaft; said pin having an upper end and a lower end; stop means at the upper end; and threading at the lower end;

whereby when the pin is inserted downwardly through the bore and matingly inserted into the threaded accepting means in the partition the head can be inserted into the socket for driving rotation thereof and thereafter lifted upwardly of said socket a distance sufficient only for free rotation of said shaft to a starting point, then said head being reinserted into said socket so the shaft c an be rotated again, and these steps are repeated as needed to tighten or remove the nut or bolt and the stop means prevents the handle assembly from being separated from the socket.

13. A wrench as described in claim 12 further comprising a spring interposed between the lower surface of the head and the upper surface of the partition and surrounding the lower portion of said pin, whereby when pressure is exerted on said shaft the spring is compressed and when pressure is release said spring expands and assists in lifting the head from the socket.

14. A wrench as described in claim 9 further comprising a second hollow cylindrical socket, said second socket having an upper chamber and a lower chamber, and fluted interior walls, the interior diameter and shape of the upper chamber being identical to the interior diameter and shape of the upper chamber of the first socket and the interior diameter of the lower chamber being larger than the interior diameter of the lower chamber of the first socket such that the second socket can be used to tighten and loosen nuts and bolts of similar diameter to the interior diameter of this lower chamber and utilizing the handle assembly.

15. A wrench as described in claim 9 further comprising a third hollow cylindrical socket, said third socket having an upper chamber and a lower chamber, and fluted interior walls, the interior diameter and shape of the upper chamber being identical to the interior diameter and shape of the upper chamber of the first socket and the interior diameter of the lower chamber being smaller than the interior diameter of the lower chamber of the first socket such that the third socket can be used to tighten and loosen nuts and bolts of similar diameter to the interior diameter of this lower chamber and utilizing the handle assembly.

16. An extension for use with a wrench of a type having a socket with fluted interior walls and a handle assembly having a head complementing the interior of the socket and affixed to one end of a shaft, said extension comprising:

an upper body member having a circular recess with fluted walls dimensioned to accept the head of the handle assembly;

a rod having a first end and a second end and being fixedly attached at its first end to the bottom of the upper body member at the center thereof;

a lower body member being cylindrical with a fluted exterior, dimensioned to be matingly accepted within the socket, and affixed to the second end of the rod; and retention means disposed within the lower body member for retaining said lower body member within said socket;

whereby when the lower body member is inserted into and retained within the socket and the handle assembly is inserted into the upper body member the wrench can be used in areas with very limited access to tighten and loosen nuts and bolts.

17. A handle assembly for driving rotation of a socket of a type having fluted interior walls, said handle assembly comprising:

a rod having a first end and a second end and a U-shaped portion substantially near the first end;

a hand grip rotatably affixed to the first end of the rod;

a head being cylindrical with a fluted exterior and dimensioned to be matingly accepted within the socket, and affixed to the second end of the rod; and retention means disposed within the head for retaining said head within said socket;

whereby when the head is inserted into and retained within the socket and the user holds the hand grip in one had and the vertical part of the U-shaped portion of the rod in the other hand and rotates the rod, the socket is rotated thereby rotating a nut or bolt held within the socket and situated in a limited access area.

18. A wrench for use in limited access areas to tighten or remove nuts and bolts, said wrench comprising:

a hollow cylindrical socket having an upper portion and a lower portion, said upper portion having fluted exterior walls and said lower portion having vertically fluted interior walls; and a handle assembly comprising a horizontal shaft and a cylindrical head fixedly attached to one end of the shaft, said head having a circular recess in the underside, said recess having fluted walls to complement and cooperate with the fluted exterior walls of the upper portion of the socket, and the head being superposable onto the upper portion of the socket for driving rotation thereof by movement of the shaft through an arc;

whereby when the socket is placed over a nut or bolt and the head is superposed onto the upper portion of the socket the shaft can be rotated thereby rotating the socket and the nut or bolt and thereafter the head is lifted from the socket, returned to the starting position, and repositioned onto the socket so the shaft can be rotated again, and these steps are repeated as needed to tighten or remove the nut or bolt.

19. A wrench as described in claim 18 further comprising:

a horizontal partition dividing the interior of the socket into an upper chamber and a lower chamber;

a threaded accepting means disposed at the center of said partition for accepting a threaded pin;

a vertical bore through the end portion of the shaft and the center of the head;

a pin substantially longer than the depth of the head, the thickness of the shaft and the depth upper portion of the socket, and having an upper end and a lower end; stop means at the upper end for preventing complete separation of said handle assembly from said socket, and threading at the lower end; and a spring for interposition between the top of the recess in the head and the upper surface of the partition and for surrounding the lower portion of said pin;

whereby when the pin is inserted downwardly through the bore and the spring and matingly inserted into the threaded accepting means in the partition and pressure is exerted on the shaft the spring is compressed and the head is superposed onto the upper portion of the socket for driving rotation thereof and thereafter when pressure is released the spring expands and assist in lifting the head from the socket a sufficient distance to permit free rotation of the shaft, and these steps being repeated to tighten or loosed a nut or bolt.

* * * * *